US008123064B2

(12) United States Patent
Vovan

(10) Patent No.: US 8,123,064 B2
(45) **Date of Patent: *Feb. 28, 2012**

(54) TAMPER EVIDENT CONTAINER HAVING A PULL-OPEN SECTION

(75) Inventor: Terry Vovan, Rialto, CA (US)

(73) Assignee: PWP Industries, Inc., Vernon, CA (US)

( * ) Notice: Subject to any disclaimer, the term of this patent is extended or adjusted under 35 U.S.C. 154(b) by 1131 days.

This patent is subject to a terminal disclaimer.

(21) Appl. No.: 11/857,144

(22) Filed: Sep. 18, 2007

(65) Prior Publication Data

US 2008/0000904 A1 Jan. 3, 2008

Related U.S. Application Data

(63) Continuation-in-part of application No. 11/315,654, filed on Dec. 21, 2005.

(51) Int. Cl.
*B65D 41/32* (2006.01)
*B65D 39/00* (2006.01)
*B65D 43/16* (2006.01)

(52) U.S. Cl. ..... 220/266; 220/789; 220/839

(58) Field of Classification Search ..... 220/266, 220/265, 260, 789, 839

See application file for complete search history.

(56) References Cited

U.S. PATENT DOCUMENTS 1,988,280 A 1/1935 Levkoff (Continued)

FOREIGN PATENT DOCUMENTS

DE 7816353 11/1978

(Continued)

OTHER PUBLICATIONS

U.S. Appl. No. 11/315,654, filed Dec. 21, 2005.

(Continued)

*Primary Examiner* — Robin Hylton

(74) *Attorney, Agent, or Firm* — Baker Botts L.L.P.

(57) ABSTRACT

A container which indicates if the lid (14) has been opened after a clerk loaded food into the base (12) and closed the lid. The base and lid each has a trapping portion (20, 22) and a pull-open portion (24, 32) with a tear-tab, or tear -open barrier (80). To close the lid, a clerk projects a tab (30) on the pull-open portion of the lid through a slot (26) in the pull-open portion of the base, and then presses down the entire trapping portion of the lid into the trapping portion of the base. The lid cannot be lifted up because the tear-open barrier (80) forming the top wall of the slot lies over the tab. To open the container, a person tears the barrier (80, FIG. 8) along a tear line (90, 92) extending from the slot (26) to the outer edge (50) of the base, or the person tears the tab to leave a short tab part that clears the barrier. The tab has a partially vertical stiffener (77) to prevent radially inward tab movement through the slot.

14 Claims, 7 Drawing Sheets

U.S. PATENT DOCUMENTS

| | | | |
|---|---|---|---|
| 2,567,013 | A | 9/1951 | Feinberg |
| 2,701,053 | A | 2/1955 | Tamarin |
| 3,572,579 | A | 3/1971 | Mueller |
| 3,773,207 | A | 11/1973 | Dokoupil et al. |
| 3,860,148 | A | 1/1975 | Sherin |
| 3,933,296 | A | 1/1976 | Ruskin et al. |
| 3,941,248 | A | 3/1976 | Moser et al. |
| 3,955,742 | A | 5/1976 | Marshall et al. |
| 3,984,025 | A | 10/1976 | Khoury |
| 4,060,176 | A | 11/1977 | Tobiasson |
| 4,113,136 | A | 9/1978 | Abbott |
| 4,139,121 | A | 2/1979 | Roccaforte |
| 4,262,814 | A | 4/1981 | Roccaforte |
| 4,520,943 | A | 6/1985 | Nielsen |
| 4,555,043 | A | 11/1985 | Bernhardt |
| 4,560,082 | A | 12/1985 | Sutch |
| 4,569,443 | A | 2/1986 | Roccaforte |
| 4,610,371 | A | 9/1986 | Karkiewicz |
| 4,627,550 | A | 12/1986 | Dines |
| 4,671,453 | A | 6/1987 | Cassidy |
| 4,721,210 | A | 1/1988 | Lawrence et al. |
| 4,742,935 | A | 5/1988 | Schellenberg |
| 4,782,977 | A | 11/1988 | Watanabe et al. |
| 4,785,963 | A | 11/1988 | Magley |
| 4,819,824 | A | 4/1989 | Longbottom et al. |
| 4,881,656 | A | 11/1989 | Chumley et al. |
| 4,930,656 | A | 6/1990 | Blanchette |
| 4,966,292 | A | 10/1990 | Marino et al. |
| 4,974,735 | A | 12/1990 | Newell |
| 4,990,345 | A | 2/1991 | Webb |
| 5,002,198 | A | 3/1991 | Smith |
| 5,007,231 | A | 4/1991 | Ingemann |
| 5,027,969 | A | 7/1991 | Lesquir |
| 5,040,695 | A | 8/1991 | Adams et al. |
| 5,052,572 | A | 10/1991 | Pherigo |
| 5,092,479 | A | 3/1992 | Wells |
| 5,111,953 | A | 5/1992 | Faust et al. |
| 5,111,954 | A | 5/1992 | Gaudreault |
| 5,115,934 | A | 5/1992 | Nelson |
| 5,129,531 | A | 7/1992 | Beck et al. |
| 5,131,551 | A | 7/1992 | Wells |
| 5,133,470 | A | 7/1992 | Abrams et al. |
| 5,163,575 | A | 11/1992 | Luch et al. |
| 5,170,905 | A | 12/1992 | Luch |
| 5,219,087 | A | 6/1993 | Christensson |
| 5,249,694 | A | 10/1993 | Nelson |
| 5,251,758 | A | 10/1993 | Kolacek |
| 5,283,940 | A | 2/1994 | Luch et al. |
| 5,300,748 | A | 4/1994 | Colombo |
| 5,303,839 | A | 4/1994 | Blumenschein |
| 5,307,948 | A | 5/1994 | Blackburn et al. |
| 5,437,386 | A | 8/1995 | Von Holdt |
| 5,507,406 | A | 4/1996 | Urciuoli |
| 5,511,679 | A | 4/1996 | Beck |
| 5,528,814 | A | 6/1996 | Luch et al. |
| 5,573,134 | A | 11/1996 | Chenault et al. |
| 5,626,251 | A | 5/1997 | Luburic et al. |
| 5,772,110 | A | 6/1998 | Garretson |
| 5,785,203 | A | 7/1998 | Arshinoff et al. |
| 5,788,105 | A | 8/1998 | Foos |
| 5,871,147 | A | 2/1999 | Smith et al. |
| 5,875,913 | A | 3/1999 | Letica |
| 5,890,648 | A | 4/1999 | Cai |
| 5,931,291 | A | 8/1999 | Sedon et al. |
| 5,931,332 | A | 8/1999 | Mygatt et al. |
| 5,979,690 | A | 11/1999 | Hartley |
| 6,000,570 | A | 12/1999 | Nelson |
| 6,045,038 | A | 4/2000 | Smith et al. |
| RE36,729 | E | 6/2000 | Luch et al. |
| 6,116,450 | A | 9/2000 | Huang |
| 6,193,921 | B1 | 2/2001 | Nelson |
| 6,257,435 | B1 | 7/2001 | Chedister et al. |
| 6,279,774 | B1 | 8/2001 | Clute et al. |
| 6,328,355 | B1 | 12/2001 | Bortz |
| 6,491,164 | B1 | 12/2002 | Virvo |
| 6,572,909 | B1 | 6/2003 | Bagwell et al. |
| 6,604,645 | B1 | 8/2003 | Vaupotic |
| 6,604,646 | B2 | 8/2003 | Torniainen et al. |
| 6,877,631 | B1 | 4/2005 | Thompson et al. |
| 6,899,245 | B1 | 5/2005 | Nelson |
| 7,004,314 | B2 | 2/2006 | Pucillo et al. |
| 7,073,680 | B2 | 7/2006 | Boback et al. |
| 7,097,043 | B2 | 8/2006 | Hsu |
| 7,118,003 | B2 | 10/2006 | Sellari et al. |
| 7,140,211 | B2 | 11/2006 | Tremblay |
| 7,172,109 | B2 | 2/2007 | Kuentseler et al. |
| 7,235,207 | B2 | 6/2007 | Gregory et al. |
| 7,311,218 | B2 | 12/2007 | Varadarajan |
| 7,325,676 | B2 | 2/2008 | Galaz |
| 7,661,547 | B2 | 2/2010 | Richir |
| 7,694,837 | B2 | 4/2010 | Robertson et al. |
| 7,757,848 | B2 | 7/2010 | Gelardi et al. |
| 2002/0088814 | A1 | 7/2002 | Belfance |
| 2002/0170914 | A1 | 11/2002 | Witt |
| 2003/0029868 | A1 | 2/2003 | Davidov et al. |
| 2003/0127419 | A1 | 7/2003 | Shenkar et al. |
| 2003/0160051 | A1 | 8/2003 | Ciccone |
| 2003/0189048 | A1 | 10/2003 | Luburic |
| 2004/0026286 | A1 | 2/2004 | Ramsey |
| 2004/0045867 | A1 | 3/2004 | Applebaum |
| 2004/0094548 | A1 | 5/2004 | Laveault |
| 2004/0108370 | A1 | 6/2004 | Lee |
| 2004/0118848 | A1 | 6/2004 | Marshall |
| 2004/0200839 | A1 | 10/2004 | Conti |
| 2004/0200891 | A1 | 10/2004 | Correll |
| 2005/0017007 | A1 | 1/2005 | Sellari et al. |
| 2005/0061861 | A1 | 3/2005 | Pennino |
| 2005/0145628 | A1 | 7/2005 | Schwarz |
| 2005/0161455 | A1 | 7/2005 | Studee |
| 2005/0173435 | A1 | 8/2005 | Wellman et al. |
| 2005/0184070 | A1 | 8/2005 | Boback et al. |
| 2005/0236413 | A1 | 10/2005 | Maciag et al. |
| 2005/0252916 | A1 | 11/2005 | Varadarajan |
| 2006/0003879 | A1 | 1/2006 | Buchman |
| 2006/0006178 | A1 | 1/2006 | Foldesi et al. |
| 2006/0011632 | A1 | 1/2006 | Caille |
| 2006/0016821 | A1 | 1/2006 | Liu |
| 2006/0144874 | A1 | 7/2006 | Solowiejko |
| 2006/0163265 | A1 | 7/2006 | De Candido |
| 2006/0201946 | A1 | 9/2006 | Witt |
| 2006/0261070 | A1 | 11/2006 | Robertson et al. |
| 2006/0266750 | A1 | 11/2006 | Lesquir |
| 2006/0289541 | A1 | 12/2006 | Boback et al. |
| 2006/0289549 | A1 | 12/2006 | Vovan |
| 2007/0062948 | A1 | 3/2007 | Albrecht et al. |
| 2007/0095848 | A1 | 5/2007 | Galland et al. |
| 2007/0108210 | A1 | 5/2007 | Alvares et al. |
| 2007/0138180 | A1 | 6/2007 | Vovan |
| 2007/0164026 | A1 | 7/2007 | Morrissey et al. |
| 2007/0202221 | A1 | 8/2007 | Hinze et al. |
| 2008/0000904 | A1 | 1/2008 | Vovan |
| 2008/0006632 | A1 | 1/2008 | Vovan |
| 2008/0185383 | A1 | 8/2008 | Philippe et al. |
| 2008/0199108 | A1 | 8/2008 | Rogers |
| 2009/0021026 | A1 | 1/2009 | Collier |
| 2009/0032545 | A1 | 2/2009 | Zeiler et al. |
| 2009/0057313 | A1 | 3/2009 | Alvares |
| 2009/0120936 | A1 | 5/2009 | Zauser et al. |
| 2009/0120942 | A1 | 5/2009 | Vovan |

FOREIGN PATENT DOCUMENTS

| | | |
|---|---|---|
| DE | 4418935 | 12/1995 |
| DE | 29819718 | 1/1999 |
| DE | 29914659 | 8/1999 |
| EP | 0752374 | 1/1997 |
| EP | 1736417 A1 | 12/2006 |
| FR | 2691952 | 12/1993 |
| FR | 2 819 496 | 7/2002 |
| GB | 2257118 | 1/1993 |
| WO | WO 2005/082733 | 9/2005 |
| WO | WO 2005/082734 | 9/2005 |

OTHER PUBLICATIONS

U.S. Appl. No. 11/879,168, filed Jul. 16, 2007.

U.S. Appl. No. 12/220,017, filed Jul. 21, 2008.

U.S. Appl. No. 11/315,654, Non-Final Rejection dated Nov. 25, 2009.

U.S. Appl. No. 11/315,654, Amendment dated Jan. 20, 2010.
U.S. Appl. No. 11/315,654, Supplemental Response dated Feb. 23, 2010.
U.S. Appl. No. 11/315,654, Restriction Requirement dated Jun. 25, 2010.
U.S. Appl. No. 11/315,654, Response to Restriction Requirement dated Jul. 26, 2010.
U.S. Appl. No. 11/879,168, Non-Final Rejection dated Jun. 10, 2010.
U.S. Appl. No. 11/879,168, Amendment dated Sep. 14, 2010.
U.S. Appl. No. 12/432,627, filed Apr. 29, 2009.
U.S. Appl. No. 12/432,627, Notice of Allowance dated Apr. 15, 2011.
U.S. Appl. No. 12/432,627, Amendment After Final dated Mar. 25, 2011.
U.S. Appl. No. 12/432,627, Final Rejection dated Jan. 26, 2011.
U.S. Appl. No. 12/432,627, Amendment dated Dec. 22, 2010.
U.S. Appl. No. 12/432,627, Non-Final Rejection dated Aug. 24, 2010.
U.S. Appl. No. 12/432,627, Response to Restriction Requirement dated Aug. 9, 2010.
U.S. Appl. No. 12/432,627, Restriction Requirement dated Jul. 8, 2010.
U.S. Appl. No. 11/315,654, Non-Final Rejection dated May 12, 2009.
U.S. Appl. No. 11/315,654, Amendment dated Aug. 10, 2009.
U.S. Appl. No. 11/315,654, Final Rejection dated Oct. 19, 2010.
U.S. Appl. No. 11/315,654, Amendment and RCE dated Jan. 19, 2011.
U.S. Appl. No. 11/879,168, Final Rejection dated Dec. 10, 2011.
U.S. Appl. No. 11/879,168, Amendment After Final dated Mar. 10, 2011.
U.S. Appl. No. 11/879,168, Advisory Action dated Apr. 26, 2011.
U.S. Appl. No. 12/327,759, filed Dec. 3, 2008.
U.S. Appl. No. 12/327,759, Non-Final Rejection dated Jan. 21, 2011.
U.S. Appl. No. 12/327,759, Amendment dated Apr. 21, 2011.
U.S. Appl. No. 12/075,549, filed Mar. 12, 2008.
U.S. Appl. No. 11/879,168, Jun. 27, 2011 Notice of Allowance.
U.S. Appl. No. 11/879,168, Jun. 10, 2011 Notice of Appeal.
U.S. Appl. No. 11/879,168, Jun. 9, 2011 Amendment after Final.
U.S. Appl. No. 12/327,759, Aug. 11, 2011 Final Office Action.
U.S. Appl. No. 12/432,627, Jul. 29, 2011 Non-Final Office Action.
U.S. Appl. No. 12/432,627, Jul. 15, 2011 Amendment after Notice of Allowance and Request for Continued Examination (RCE).
U.S. Appl. No. 11/075,549, Jul. 22, 2011 Non-Final Office Action.
U.S. Appl. No. 11/879,168, Sep. 27, 2011 Issue Fee paid.
U.S. Appl. No. 12/075,549, Oct. 18, 2011 Response to Non-Final Office Action.
U.S. Appl. No. 12/220,017, Oct. 19, 2011 Non-Final Office Action.

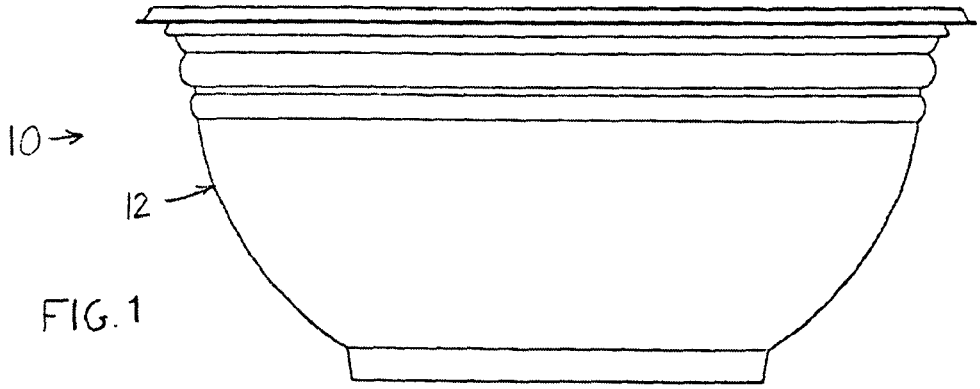
FIG. 1
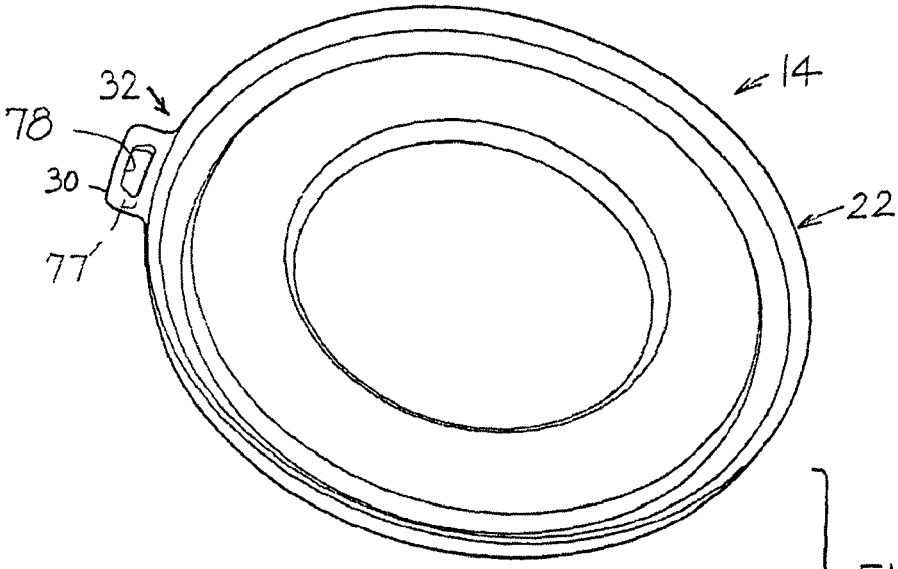
FIG. 2
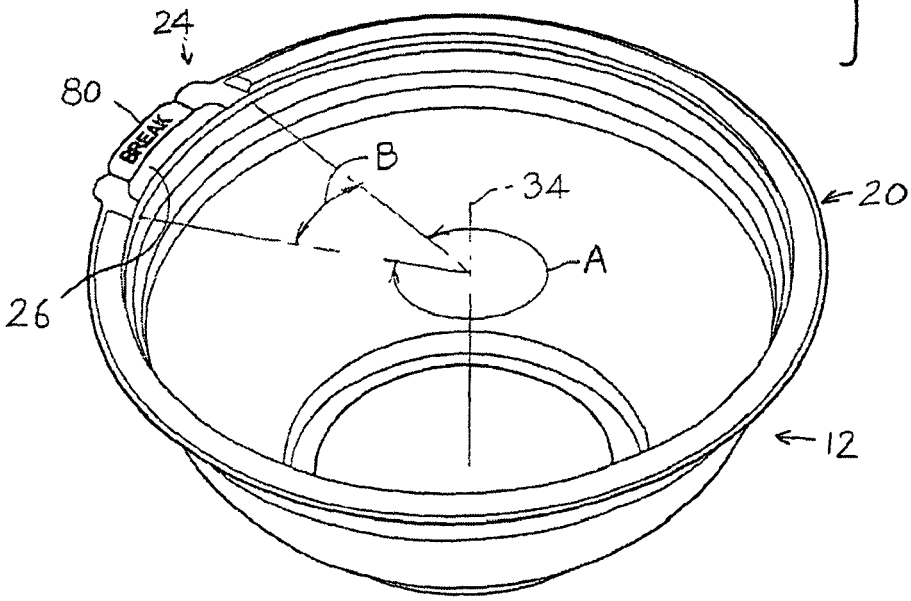

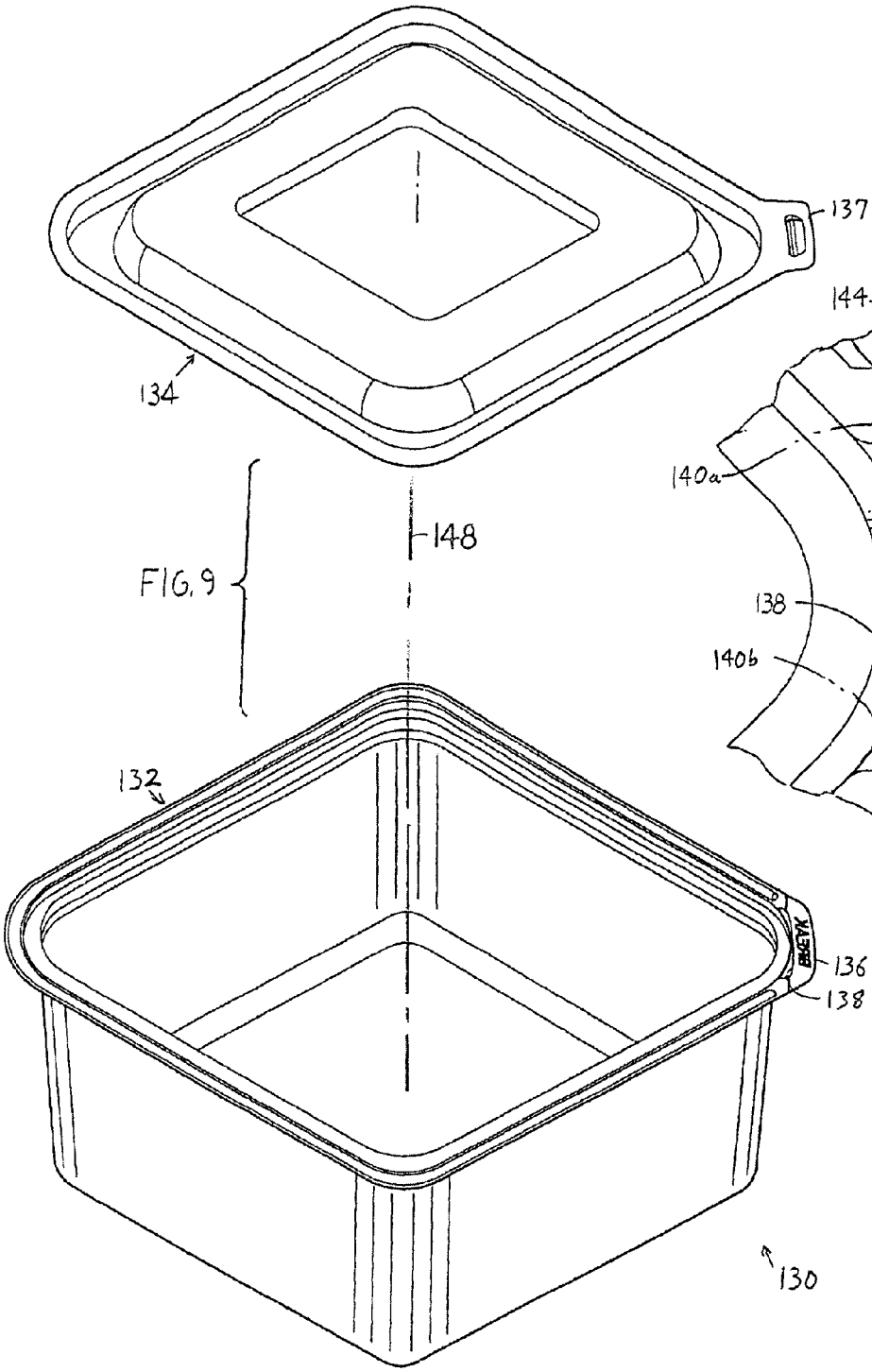
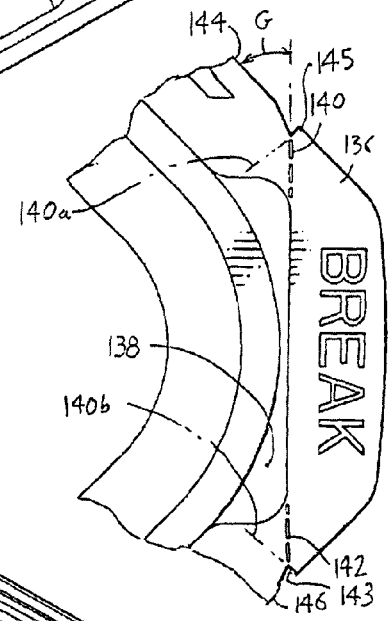
FIG. 10

TAMPER EVIDENT CONTAINER HAVING A PULL-OPEN SECTION

CROSS-REFERENCE

This is a continuation-in-part of U.S. patent application Ser. No. 11/315,654 filed Dec. 21, 2005.

BACKGROUND OF THE INVENTION

Food is often placed in a transparent plastic container that includes a base with a large volume cavity that holds the food and with a cover or lid that closes the cavity. Buyers want to be assured that, after the food was placed in the container as by a clerk at the food store, that the container has not been opened. There is a possibility that another customer has secretly opened the container enough to taste a bit of the food before closing it (and possibly leaving germs from his/her finger in the food). Potential buyers want to be assured that this has not happened. A container constructed by the container manufacturer that allowed a clerk at the store to automatically activate a device that clearly indicated to a potential customer whether or not the container has been opened since it was first closed by the clerk, would be of value.

SUMMARY OF THE INVENTION

In accordance with one embodiment of the invention, a container is provided of the type that includes a base and lid having an axis, which allows the lid to be closed and thereafter prevents the lid from being opened unless a tear line is broken. The container and lid each have trapping portions and pull-open portions. The base pull-open portion forms a slot and a barrier lying radially beyond the slot. The pull-open portion of the lid has a pull-up tab that is projected to extend primarily horizontally through the slot when the lid is closed. When the lid is closed the trapping portion of the base traps the lid in the closed position and prevents the lid from opening unless the pull-open side of the lid is pulled up. To open the lid, the barrier is broken, or a radially outer portion of the tab is torn off, so the pull-up tab on the lid can be pulled up to release the lid from the base.

The novel features of the invention are set forth with particularity in the appended claims. The invention will be best understood from the following description when read in conjunction with the accompanying drawings.

DESCRIPTION OF THE DRAWINGS

FIG. 1 is a side elevation view of a container of the invention, with the lid closed on the base.

FIG. 2 is an exploded isometric view of the base and lid of the container of FIG. 1.

FIG. 9 is an exploded isometric view of another container of the invention, wherein the container is of a polygon shape instead of a bowl shape.

FIG. 10 is a partial plan view of the barrier of the base of the container of FIG. 9.

DESCRIPTION OF THE PREFERRED EMBODIMENTS

Figure 3:
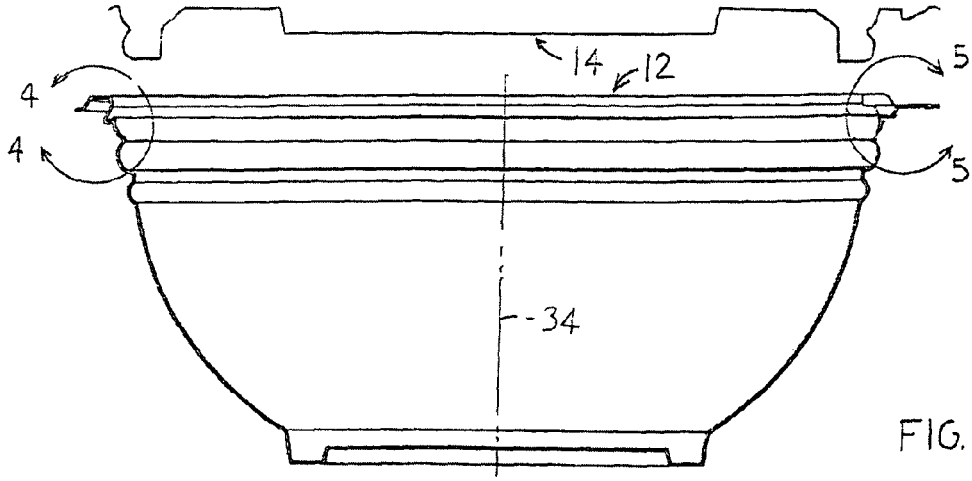
FIG. 3 is an exploded sectional side view of the container of FIG. 1.

FIGS. 1 and 2 show a bowl-shaped container 10 of the invention, which includes a base 12 and a lid 14 that can be closed on the base. The base and lid are constructed of plastic sheeting which has been deformed as by vacuum forming. The particular base and lid of FIG. 1 are formed to two pieces of plastic sheet. The base has a trapping side or portion 20 that receives a trapping portion 22 of the lid and thereafter resists lid removal. The base also has a pull-open side or portion 24 with a horizontally-open slot 26 that receives a lift tab, or pull-up tab 30 of a pull-open or pull-out portion 32, or section, of the lid. The slot 26 has a continuous periphery, that is, the slot walls extend entirely around the slot without a gap. The trapping portions or sections of the base and lid extend at an angle A of at least 300° around the vertical axis 34 of the closed container. The trapping portion could extend 360°. The pull-open portions of the base and lid extend by an angle B that is preferably less than 90° around the axis. In the following discussion it is assumed that the bottom of the base rests on a substantially horizontal surface (a surface within 10° and usually with in 5°, of the horizontal).

Figure 6:
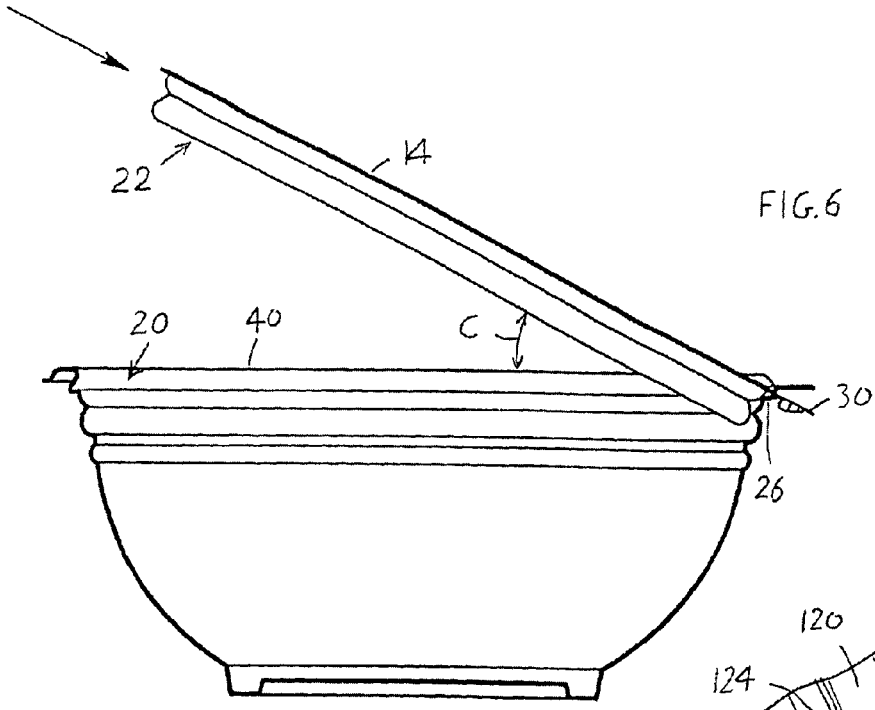
FIG. 6 is a side view of the container of FIG. 3, with the base shown in section and the lid shown in elevation, showing the tab of the lid being projected though a slot in the base, during first closing of the container.
Figure 7:
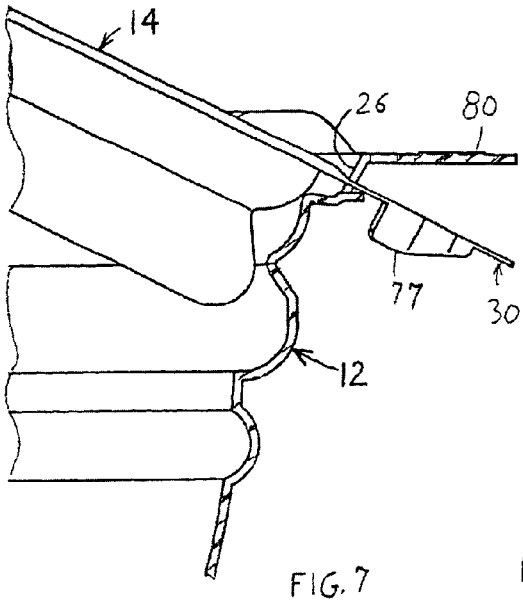
FIG. 7 is an enlarged view of an area of FIG. 6, showing the tab projected though the slot during the first closing of the container.

The lid is installed in the manner shown in FIG. 6, by holding the lid 14 at an incline C such as about 30° to the horizontal and to the top 40 of the base, and projecting the tab 30 of the lid through the slot 26 in the base. Then the trapping portion 22 of the lid is pushed down forcefully into the trapping portion 20 of the base. This results in the trapping portion of the lid being trapped in place deep in the base.

Figure 4:
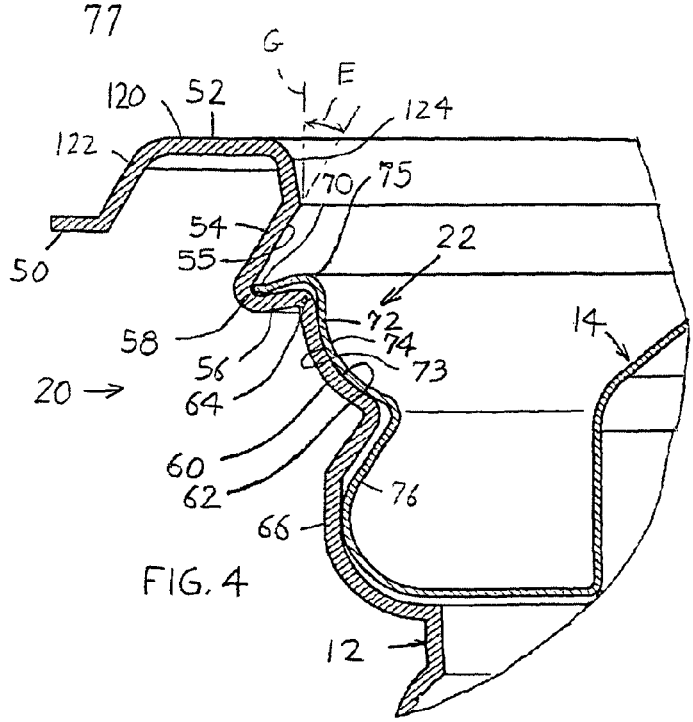
FIG. 4 is an enlarged sectional view of area 4-4 of FIG. 3, with the lid closed on the base.

FIG. 4 shows the trapping portions 20, 22 of the base and lid in their fully trapped positions. The base has an outer edge part 50, and has an upward flange 52 extending radially inward of and above the base outer edge. The term "radially" describes a direction with respect to the axis 34 of the container, so "radially inward" or just "inward" means toward the axis and "radially outward" or just "outward" means away from the axis. Terms such as "inner" surface means the surface closest to the axis.

The base shown in FIG. 4 has a trapping wall 54 extending at a downward and radially outward incline from the inside of flange 52, and has a stop wall 56 that lies at the bottom of the trapping wall. The trapping wall is joined to the stop wall at a corner 58, and the stop wall extends radially inward from the corner 58. The base also has an upper seal wall 60 with a concave inner surface 62, that extends at a downward-inward incline from a corner 64 at the inside of the stop wall. The base has a lower seal wall 66. The lid has corresponding walls, including a radially outward free peripheral lip 70, and an upper seal wall 72 with a concave inner surface 74 that is joined to the lip by a large radius corner 75 whose radius is larger than that of the base corner 64. The lid also has a lower seal wall 76. The inside radius of curvature of the lid corner 75 is at least 150% of the radius of curvature of the inside of the base corner 64.

When the lid is pushed down forcefully into the base, the peripheral lip 70 of the lid snaps down to the position shown in FIG. 4, with the lip 70 lying at the bottom of the trapping wall 54, at the corner 58. The trapping wall 54 extends at a downward-outward incline from a vertical G, which is preferably between 5° and 30°, to the vertical. The peripheral lip 70 is unreinforced so it readily bends up when pushed down along the inside of the trapping wall, and then is trapped in place. The peripheral lip 70 could be forcefully pulled up, but a person cannot firmly grasp the lip to pull it up, and it requires a large upward force to pull it up. It is easy to push down the lip into place but almost impossible to pull up the lip, unless the pull-open portion of the lid is first pulled up.

Figure 5:
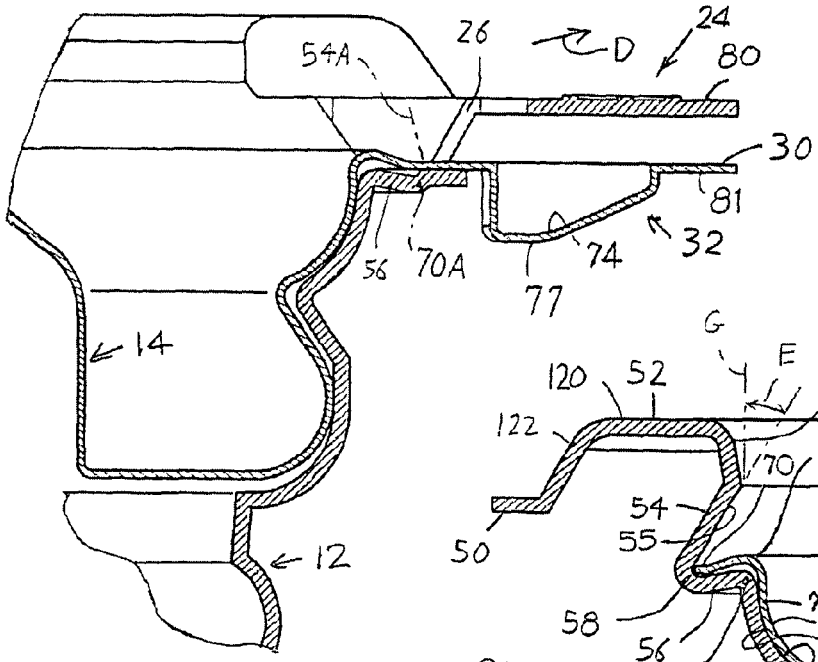
FIG. 5 is an enlarged sectional view of area 5-5 of FIG. 3, with the lid closed on the base.

FIG. 5 shows the pull-open portions 24, 32 of the base and lid when the lid has been fully closed on the base. The point 70A represents a location of the same height and radial position where the peripheral lip of the lid would lie at the bottom of the trapping wall at 54A, in the trapping portion of the container. Instead, the pull-open portion of the lid forms the lift tab 30, which projects primarily radially outward through the slot 26 in the pull-open portion of the base. The position otherwise occupied by a trapping wall 54A on the base is devoid of the trapping wall along the pull-open portion. Instead, the base has a tear-tab, or barrier wall, or barrier 80 that forms the upper wall of the slot 26 in the base. The lid forms the pull-up tab 30 that projects primarily radially though the slot 26 and that has a radially outer portion 81 (radially with respect to axis 34) that lies under a radially outer portion 80 of the base slot walls). The slot 26 has a small enough height and the tab 30 has a sufficient radial length and has a stiffener 77 formed by a downward recess 74 in the tab, that a person normally cannot bend the tab and push it inwardly to lie inward of the slot 26 to raise the tab. The stiffener 77 serves as a barrier to moving the tab backward (radially inward) through the slot. Instead, the only practical way for a person to raise the tab is to tear away the barrier 80. The recess 74 is in the form of a blind hole.

Figure 8:
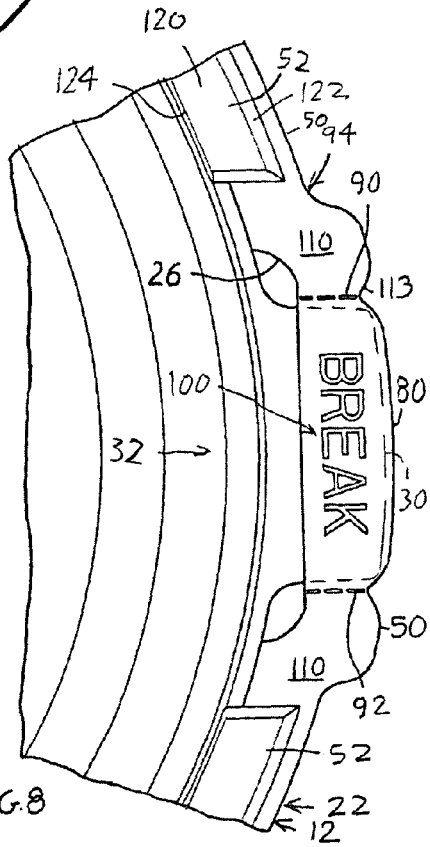
FIG. 8 is a plan view of the area of the container of FIG. 7, after the lid has been fully closed.

FIG. 8 shows that the barrier 80 is attached by two tear joints 90, 92 to a major portion 94 of the base, which is primarily the trapping portion of the base. The tear joints 90, 92 are located at circumferentially opposite ends of the upper slot wall 80. The fact that a tear line extends from a slot 26 to the outer edge 50 of the base, results in a short tear line(s). This is especially the case where the tear line(s) extends at least partially radially to the axis 34, especially within 60° of a radial direction. The tear joints, which extend perpendicular to adjacent parts of the edge 50, are weakened by perforations, notches or by a groove passing partway though the sheet at each tear joint. The barrier has an indication 100, formed by the word "BREAK" that indicates that the barrier should be broken. Upon breaking the barrier 80 at one or both joints, a gap can be easily created and the lift tab 30 can be lifted. When the lift tab is tilted by several degrees (preferably at least 15°) such as 20° or more, the lid can be pulled along the upwardly inclined direction D (FIG. 5) to remove the lid from the base. Once the barrier has been broken, the lid can be repeatedly closed and opened using only moderate force applied to the lift tab, and the container seals the contents each time the lid is closed.

FIG. 8 shows transition regions 110 at opposite sides of the trapping portion 22 of the base. The plastic sheet of the base, which is vacuum formed, has a flat portion between the ends of the flange 52. The flange 52 forms the top 120 of the container and has opposite flange sides 122, 124 that strengthens the upper part of the base to support the weight of other similarly loaded containers that are stacked on one another. A circumferential gap in the flange that is much less than 90°, such as the gap of about 35° occupied by the pull-open portion 32, allows stable stacking of the containers.

FIG. 9 shows another container 130 that is similar to the bowl-shaped container of FIGS. 1-8, but that has a regular polygon shape as seen in a plan view. The particular container shown is of square overall parallelepiped shape. The container 130 has a base 132 and lid 134 similar to that of the bowl-shaped container, except that the barrier 136 lies at one corner of the square shape. The lid has a pull-up tab 137 that fits in a slot 138 under the tear-tab barrier 136. FIG. 10 shows that the break lines 140, 142 of the barrier wall extend at angle G of about 45° (which is a plurality of degrees less than 90°) to adjacent sides 144, 146 of the square and approximately circumferential to the container axis 148. If the break lines were positioned at 140*a*, 142*a* where they extended perpendicular to the sides, then this would result in projecting sharp corners, when the barrier 136 was torn off, which might hurt a person.

Figure 11:
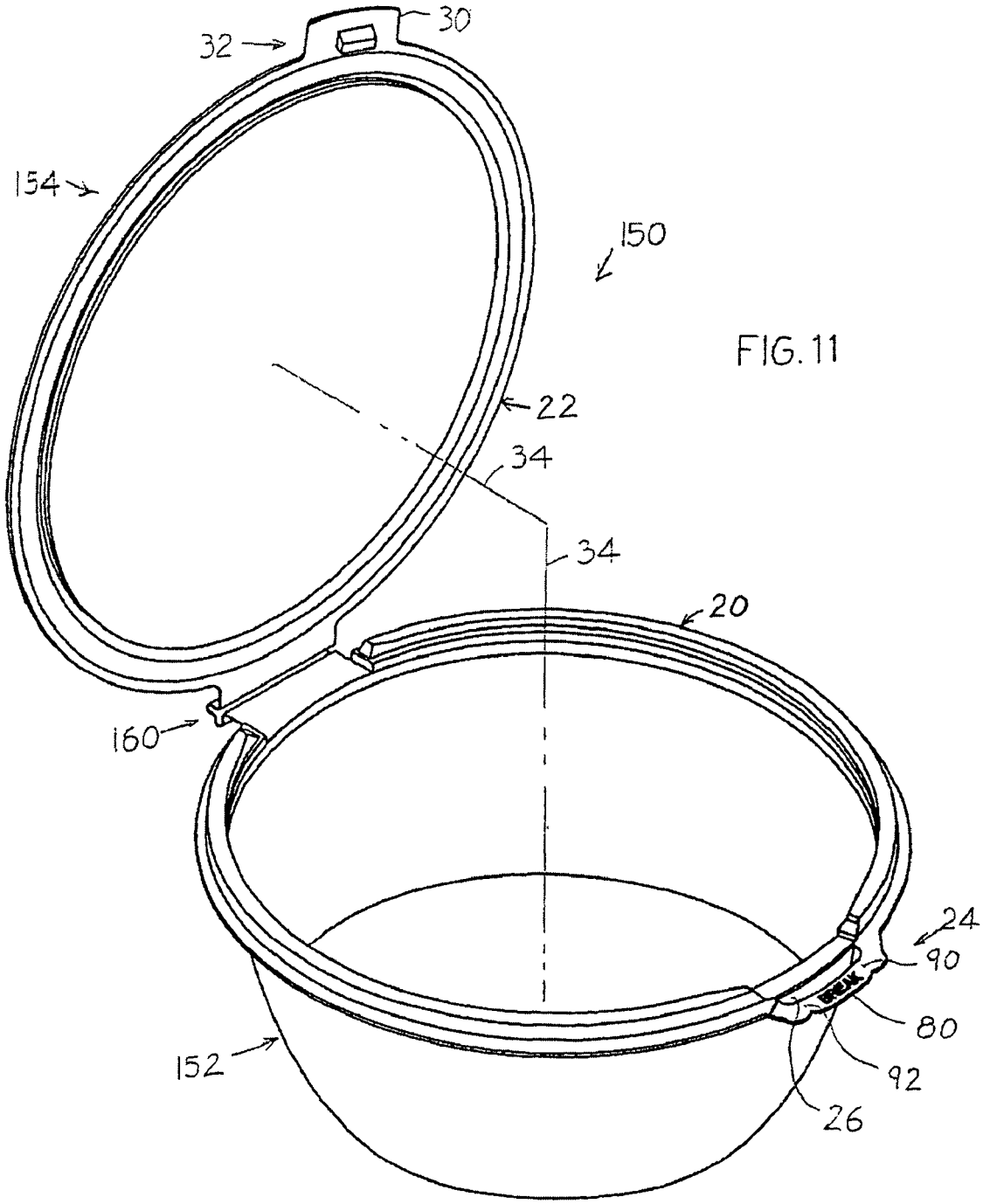
FIG. 11 is an isometric view of a container in an open position, wherein the based and lid are formed of a single plastic sheet.

FIG. 11 illustrates another container 150 that has a shape and construction similar to the bowl of FIGS. 1-8, but wherein the base 152 and lid 154 can be formed of a single piece of sheet plastic. The base and lid are joined by a hinge portion 160. The base and lid have pull open sections 24, 32 and trapping sections 20, 22, of the same construction as the container of FIGS. 1-8.

Figure 12:
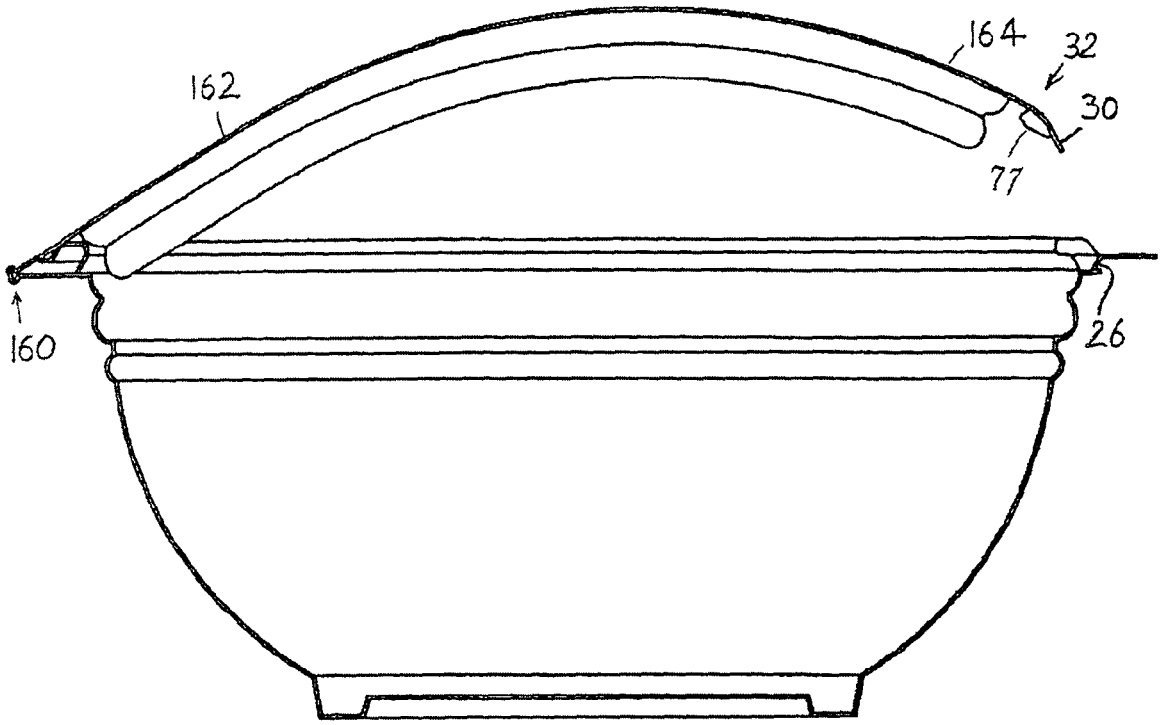
FIG. 12 is a side elevation view of the container of FIG. 11, in the course of latching the lid closed.
Figure 13:
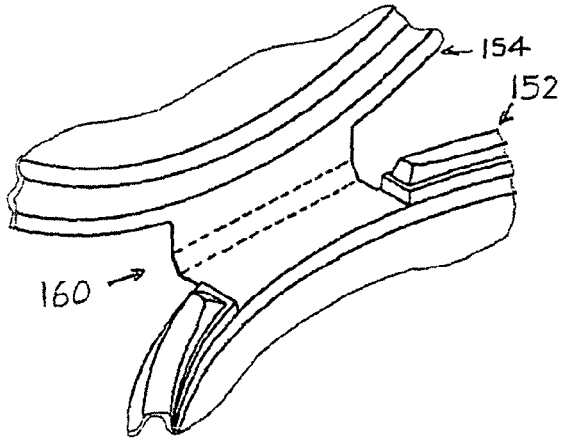
FIG. 13 is a partial isometric view of another hinge of a container formed of a single plastic sheet.

FIG. 12 shows the lid with one lid side 162 extending at an upward incline of about 30° away from the hinge 160, and with the lid being bent so its opposite side 164 which is nearest the pullout section 32 extending horizontally or at a downward incline away from the hinge. This shortens the distance from the hinge 160 to the lift tab 30, sufficiently for the lift tab to be inserted through the slot 26. The trapping section 22 (FIG. 11) of the lid is pressed down into the trapping section 20 of the base. Thereafter, the lid can be opened only by tearing one or both tear joints 90, 92, followed by lifting the lift tab 30. FIG. 13 shows one possible construction of the hinge 160 which joins the base 152 to the lid 154.

Figure 14:
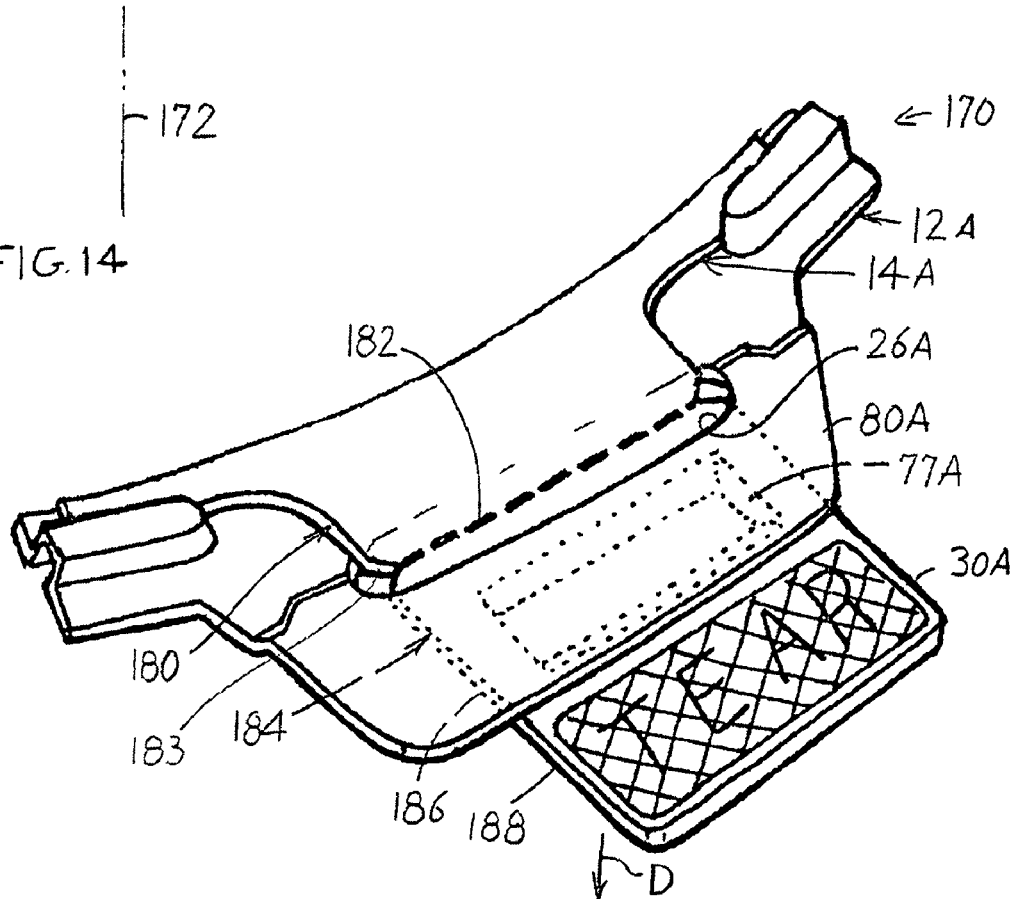
FIG. 14 is a partial isometric view of a container of another embodiment of the invention.

FIG. 14 shows a container 170 of another embodiment of the invention, with a lid 14A that has a lid tab 30A, and a base 12A with a slot 26A and a barrier wall 80A lying radially beyond the slot. The lid tab 30A projects through the base slot 26A and radially (with respect to the container axis 172) beyond the barrier wall 80A. In this embodiment of the invention, the lid tab has a radially inner tab part 180 that is connected by a tear line 182 to an outer tab part 184. The outer tab part includes a middle section 186 that lies under the barrier 80A and a beyond tab section 188 that lies (radially or circumferentially) beyond the barrier 80A. To lift the lid, a person grasps the beyond tab section 188 and moves it (up, down, or in a twist) to tear the outer tab part 184 away from the inner tab part 180 along the tear line 182 to separate them. Then, the inner tab part 180 can be grasped and lifted to lift the lid.

Figure 15:
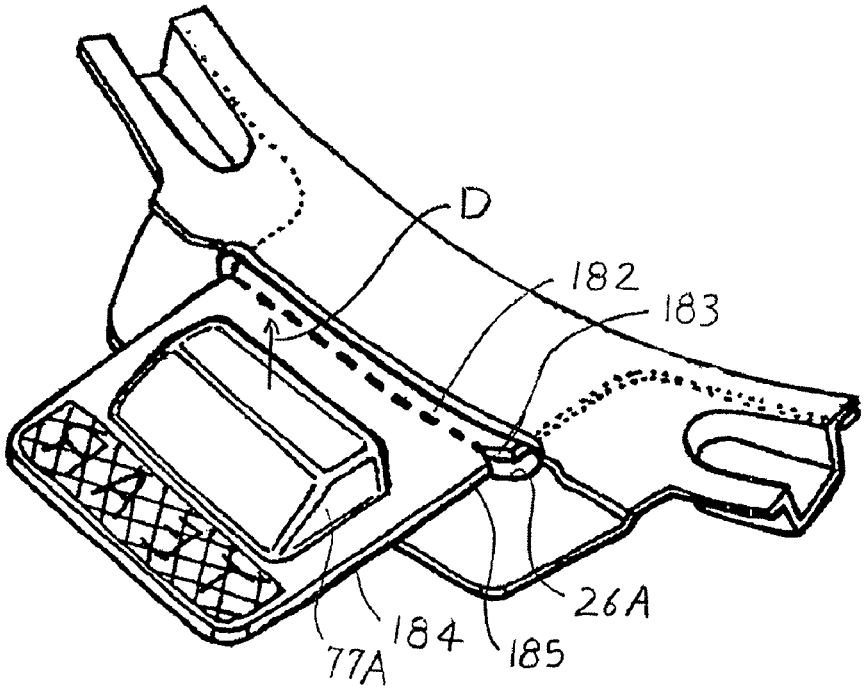
FIG. 15 is an upside-down isometric view of the container of FIG. 11.

FIG. 15 is an upside-down view that shows that the outer tab part 184 has a projection, or stiffener 77A that projects at least partially downward D from the outer tab part. The stiffener not only stiffens the tab outer part but serves as a barrier that prevents the tab outer part 180 from moving radially inward back through the slot 26A. The stiffener 77A can have a variety of shapes including that of a triangle or other polygon.

Applicant prefers to construct each tear line, such as 182 in FIGS. 15 and 140, 142 in FIG. 10, with a lead-in notch 183, 143. The notch is formed in an edge 185, 145 of the part that forms the tear line. The notch provides a weakened edge where a tear can start that progresses along a tear line.

Thus, the invention provides a container with a base and lid, which enables a store clerk to close the container the first time, after loading food or other goods in the base, and to insert a lid tab through a base slot. Of the slot walls and lid tab, one of them has a tear line that can be torn to allow at least one of them to be pulled up past the barrier. Thus the container cannot be opened without breaking at least one end of a barrier or a part of the tab. The tab has a largely vertical projection that prevents it from being pushed backward through the slot. Of course, the fact that the barrier or tab has been broken is obvious to any customer, so if the customer sees that the tear-open barrier or tab is not broken the customer will be assured that the container has not been opened. The container has trapping and pull-open portions or sections. The trapping section allows the lid to be forced down to a fully installed position and thereafter prevents the lid from being pulled up unless the pull-open section has been lifted and preferably also pulled away slightly from the center of the trapping portion. The container forms a seal around the entire container circumference, which is broken only when the pull-up tab is pulled up.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A container having a base and lid formed of at least one deformed sheet of plastic sheeting, wherein said base and lid are centered on a vertical axis and said base and lid each has a trapping section and a pull-open section, said trapping section of said base has a trapping wall that allows the trapping section of the lid to be inserted to an installed position and then resists the trapping section of the lid from being pulled up, wherein:

said pull-open section of said base has slot walls that form a horizontally-opening slot with a continuous slot periphery, and said pull-open section of said base forms a barrier wall extending from at least a part of said slot periphery, said base having an outer edge that extends along an outer edge of said pull-open section;

said pull-open section of said lid has a pull-up lid tab that projects primarily horizontally through said slot and that has a radially outer portion that lies under said barrier wall so said barrier wall prevents the pull-up lid tab from being pulled up;

at least one of said base slot walls and lid tab has a tear line that can be torn to enable at least part of said pull-up tab to be pulled up past said barrier wall to lift said lid.

2. The container described in claim 1 wherein:

said pull-up tab of said lid has a partially vertical projection that resists radially inward sliding of the pull-up tab of the lid by engagement with a wall of said slot that lies radially inward of said slot.

3. The container described in claim 2 wherein:

said slot more readily passes said projection radially outward through the slot when said lid and tab are tilted from the horizontal, than when said lid and tab are horizontal.

4. The container described in claim 1 wherein:

said tear line lies in said barrier wall of said base with said tear line extending from said slot to said outer edge of said base.

5. The container described in claim 1 wherein:

said tear line extends at least partially radially to said axis between said slot and said outer edge of said base.

6. The container described in claim 1 wherein:

said tear line extends across said pull tab, so the pull tab can be torn to allow a portion of the pull tab to be lifted to lift said lid.

7. The container described in claim 1 wherein:

said pull tab has radially inner and outer pull tab portions, with said outer pull tab portion having a first part that lies under said barrier wall and having a second part that extends beyond said barrier wall, and with said inner pull tab portion lying primarily radially inward of said barrier wall.

8. The container described in claim 1 wherein:

of said base slot walls and said lid tab, the one that has said tear line has an edge with a notch that leads to an end of the tear line.

9. A container that includes a base and lid formed of deformed sheet plastic, wherein said base and lid are centered on a vertical axis and said lid fits partially into said base, said base and lid each has a trapping section that extends partially about said axis where said lid is trapped in said base when said lid is installed therein, and said base and lid each has a pull-open section that extends less than 180° about said axis where said lid can be pulled up out of said base, wherein:

at said pull-open section, said base has slot walls that form a radially-opening slot with a slot periphery that extends continuously around said slot, said slot walls forming a barrier wall that extends radially beyond said slot; at said pull-open section, said lid forms a radially-outward projecting pull tab that extends primarily horizontally through said slot;

at least one of said slot walls and said pull tab has a tear line where the sheet plastic is weakened, to facilitate tearing along the tear line to free at least part of the tab to be pulled up above said barrier wall;

said pull tab has at least one partially vertical stiffener extending downward from said tab upper surface, to resist sliding said tab back through said slot.

10. The container described in claim 9 wherein: said one of said slot walls and pull tab that forms said tear line, has an edge with a notch therein that leads to an end of the tear line.

11. The container of claim 1, wherein the base further comprises an outer edge part coplanar with the barrier wall.

12. The container of claim 9, wherein the base further comprises an outer edge part coplanar with the barrier wall.

13. A container having a base and a lid formed of deformed sheet plastic, wherein the base and the lid are centered on a vertical axis and the base and the lid each have a trapping section and a pull-open section, the trapping section of the base having a trapping wall that allows the trapping section of the lid to be inserted to an installed position and then resists the trapping section of the lid from being pulled up, wherein:

the pull-open section of the base comprises slot walls that form a horizontally-opening slot with a continuous slot periphery, and a barrier wall extending from at least a part of the slot periphery; and the pull-open section of the lid comprises a pull tab that projects primarily horizontally through the slot, wherein a tear line extends across the pull tab so the pull tab can be torn to allow a portion of the pull tab to be lifted to lift the lid.

14. A container having a base and a lid formed of deformed sheet plastic, wherein the base and the lid are centered on a vertical axis and the base and the lid each have a trapping section and a pull-open section, the trapping section of the base having a trapping wall that allows the trapping section of the lid to be inserted to an installed position and then resists the trapping section of the lid from being pulled up, wherein:

the pull-open section of the base comprises slot walls that form a horizontally-opening slot with a continuous slot periphery, and a barrier wall extending from at least a part of the slot periphery; and the pull-open section of the lid comprises a lid tab that projects primarily horizontally through the slot, the lid tab having radially inner and outer lid tab portions, with the outer lid tab portion having a first part lying under the barrier wall and having a second part that extends beyond the barrier wall, and with the inner lid tab portion lying primarily radially inward of the barrier wall; and wherein at least one of the slot walls and the lid tab has a tear line that can be torn to enable at least part of the lid tab to be pulled up past the barrier wall.

* * * * *